US012180596B2

(12) United States Patent
von Schleinitz et al.

(10) Patent No.: US 12,180,596 B2
(45) **Date of Patent: *Dec. 31, 2024**

(54) COMPONENT

(71) Applicants: Aktiebolaget SKF, Gothenburg (SE); DEWE Brünofix GmbH, Rednitzhembach (DE)

(72) Inventors: Thilo von Schleinitz, Schweinfurt (DE); Christina Bruckhaus, Rednitzhembach (DE)

(73) Assignees: Aktiebolaget SKF, Gothenburg (SE); DEWE Brünofix GmbH, Rednitzhembach (DE)

( * ) Notice: Subject to any disclaimer, the term of this patent is extended or adjusted under 35 U.S.C. 154(b) by 106 days.

This patent is subject to a terminal disclaimer.

(21) Appl. No.: 17/849,789

(22) Filed: Jun. 27, 2022

(65) Prior Publication Data

US 2022/0411935 A1 Dec. 29, 2022

(30) Foreign Application Priority Data

Jun. 29, 2021 (DE) ..... 10 2021 206 711.5

(51) Int. Cl.
*C23C 22/80* (2006.01)

(52) U.S. Cl.
CPC ..... *C23C 22/80* (2013.01)

(58) Field of Classification Search
None
See application file for complete search history.

(56) References Cited

U.S. PATENT DOCUMENTS

| | | | | |
|---|---|---|---|---|
| 2,817,610 | A * | 12/1957 | Newell | C23C 22/62 148/271 |
| 6,309,476 | B1 | 10/2001 | Ravenscroft et al. | |
| 8,318,256 | B2 | 11/2012 | Ishii et al. | |
| 2013/0089283 | A1 | 4/2013 | Trojahn et al. | |

FOREIGN PATENT DOCUMENTS

| | | | |
|---|---|---|---|
| BE | 552779 | A | 1/1960 |
| DE | 613762 | C | 5/1935 |
| DE | 102007048750 | A1 | 4/2009 |
| DE | 102008060955 | A1 | 6/2009 |
| DE | 102016210507 | A1 | 12/2017 |

(Continued)

OTHER PUBLICATIONS

European Search Report (Oct. 22, 2022) from corresponding European App. EP22178174.

(Continued)

*Primary Examiner* — Kim S. Horger
(74) *Attorney, Agent, or Firm* — WRB-IP PLLC

(57) ABSTRACT

A component (1) is disclosed which has a black oxide layer (10), wherein metallic additive elements (4) are incorporated in the structure of the black oxide layer (10). Furthermore, a method for manufacturing such a component (1) is disclosed, said method comprising the steps of: depositing metallic additive elements (4) on the component (1) and immersing the component (1) with the deposited metallic additive elements (4) in a black oxide solution (6), wherein the metallic additive elements (4) are incorporated into the structure of the black oxide layer (10).

9 Claims, 1 Drawing Sheet

(56) References Cited

FOREIGN PATENT DOCUMENTS

| | | | |
|---|---|---|---|
| EP | 2203576 | B1 | 5/2019 |
| JP | 2010215936 | A | 9/2010 |
| WO | 2021139973 | A1 | 7/2021 |

OTHER PUBLICATIONS

German Official Action (Jan. 28, 2022) for corresponding German App. DE102021206711.5.
Chinese Official Action (Jan. 30, 2024) for corresponding Chinese App. 202210704509.9.
Chinese Official Action (Jul. 6, 2024) for corresponding Chinese App. 202210704509.9.

* cited by examiner

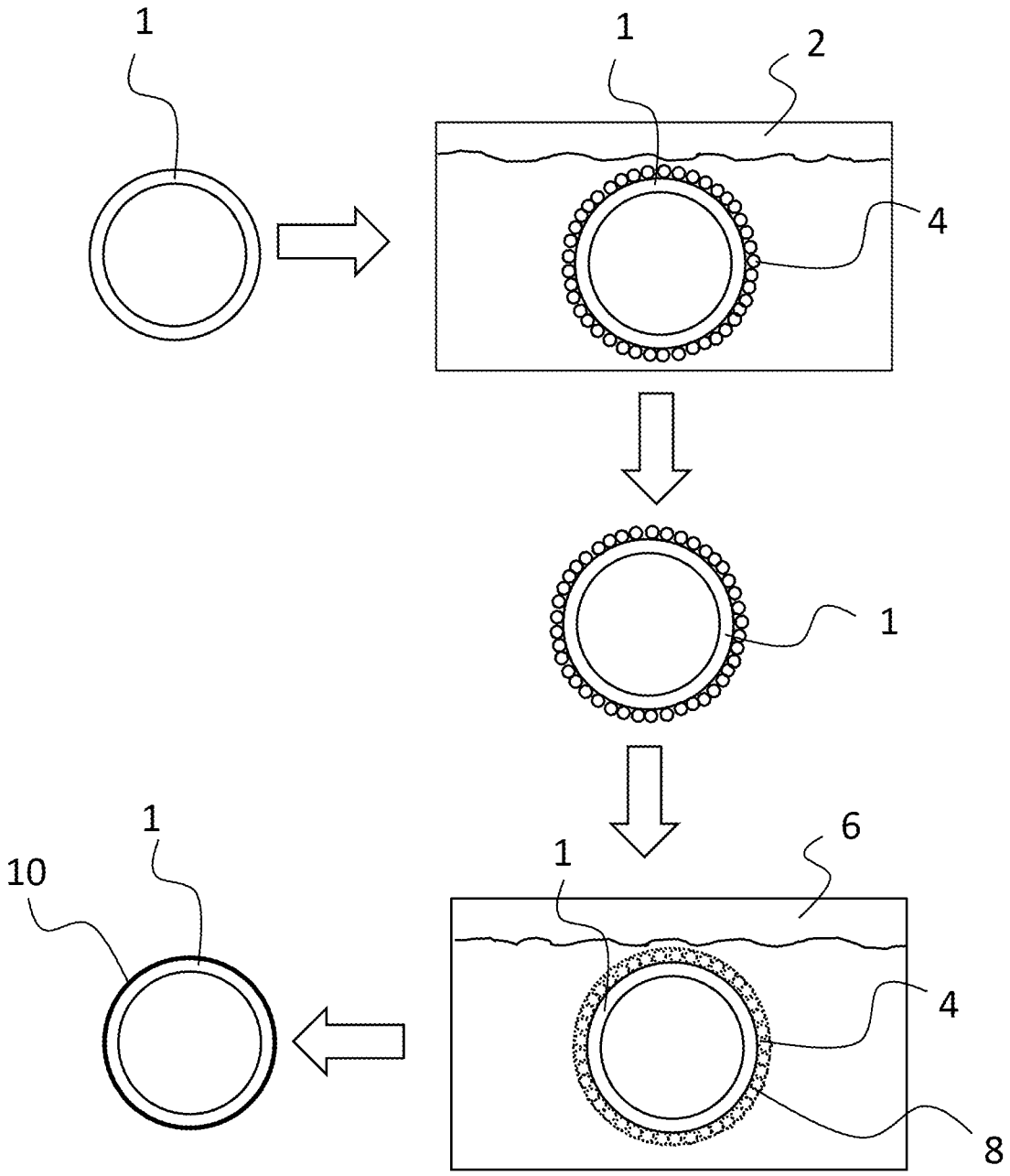
1
1
2
4
1
1
6
10
1
4
8

COMPONENT

BACKGROUND AND SUMMARY

The present invention relates to a component with a black oxide layer and to a method for manufacturing such a component.

It is known to apply blackening to components in order to achieve protection of the components from various damages occurring on the surface due to sliding motions. In this process, the iron of the surface of the component is immersed in one or more oxidising baths. This creates a conversion layer being firmly bonded to the base material, which does not substantially affect the dimensions of the component.

The wear resistance of such a black oxide is sometimes too low for very wear-intensive applications so that the black oxide is already weakened or worn off after a test run or run-in, whereas, in other more favourable applications, it is stable for years. The observed erosion of the layer is often related to sliding motion shares. If the layer is in sliding contact with a counterface, it can be removed after a very short time because it has a lower hardness than the usually hardened steel of the counterface.

It is therefore an object of the present invention to provide a component with increased wear resistance.

Generally, coatings can be favourably influenced by depositing additional substances. Up to now, it has been known to produce a black oxide layer on a component and then to apply a further layer with various additional elements, such as tungsten compounds, or even polymers, on the black oxide layer in order to strengthen the black oxide layer or to provide further properties by the layer. However, this has the disadvantage that the additional elements represent a separate layer that is not able to improve properties of the black oxide layer itself, such as wear resistance.

However, it has now been discovered by the inventor that it is possible to improve the properties of the black oxide layer by carrying out a type of alloying of the black oxide layer. By means of such an alloy, the properties of the layer produced during blacking can be adapted, in particular improved.

A component is therefore proposed which has a black oxide layer. The component, which is not a bearing component, may in particular be a component which is subjected to sliding motion, such as guide rods, piston rods, steering components, linear guidings and slides. Gun catches on blackened guns are also subject to sliding wear.

In order to provide a resistant black oxide layer, metallic additive elements are incorporated into the structure of the black oxide layer. The metallic additive elements are not provided as a separate layer that provides its own properties, but are embedded directly in the black oxide layer, i.e., integrated into the structure of the black oxide layer. In this way, they adapt the properties of the black oxide layer instead of adding further properties of the additional elements.

The alloyed black oxide layer is arranged on an area of the component that is free of rolling contact. This area can, for example, be subjected to a sliding motion, as it is the case with piston rods, etc.

By manufacturing as an alloyed black oxide layer, the metallic additive elements are essentially incorporated over the radial extension of the black oxide layer or at least over a significant part of the radial layer extension. In contrast to previous manufacturing processes, in which additive elements are only present in the radial border regions of the black oxide layer, i.e., on the black oxide layer or in its surface-open cavities and pores, the metallic additive elements provided here are to be found in the radial extension of the black oxide layer, i.e., within the layer structure and not only on top of the layer. In this way, the metallic additive elements contribute to an improvement of the properties of the black oxide layer over its radial extension.

In rolling bearings, a black oxide layer necessarily and intentionally loses about 50% of its oxidation depth during running-in, while the remaining 50% then usually protects the surface in a stable and long-term manner as a residual layer. Thus, it is only necessary to achieve a change in the layer properties to more than 50% of the oxidation depth in order to modify the properties of the layer remaining after running-in. A change in the layer properties over the complete oxidation depth of the black oxide layer is desirable and ideally present but is not absolutely necessary for the improved stability of the layer.

According to one embodiment, the metallic additive elements are provided with a percentage of between 0.1 and 1%, in particular between 0.3 and 0.7% (mass percentage), of the black oxide layer. Due to these low percentages of metallic additive elements, it can be achieved that these do not change the overall properties of the black oxide layer by their own properties as a material, but instead adapt the properties of the actual black oxide layer. The mass percentages used are similar to various percentages of alloying elements in steel, where significant changes in properties are also achieved despite low concentrations well below 1%.

On the one hand, the low concentration of the additive elements allows a resource-saving coating process without high chemical input, without high losses, and without high costs. On the other hand, the maintenance of the black oxide bath and analytics is also simple.

If additional elements would be deposited as "islands" in a layer in order to significantly change the overall properties of the layer by the specific properties of the additional elements, several mass percentages of additional elements would have to be introduced into the layer. Such massive island formations could disturb the homogeneous properties of the layer, endanger the internal stability, and would require a high material input of additional elements in the coating process.

If one wants to position additional elements not on a layer but in a layer, it is therefore ideal if the additional elements are distributed in the layer by structural connections, for example in the crystal lattice structure, or by chemical reactions and are not present as island-shaped separated agglomerates. This is achieved by the component described herein. At the same time, the incorporation of the metallic additive elements into the basic structure of the layer makes it possible to achieve relevant property improvements despite very low concentrations.

According to a further embodiment, the metallic additive elements are incorporated in the black oxide layer with a percentage that increases radially outwards.

Blackening is achieved by immersing the component in one or more black oxide baths. During the immersion, continuous dissolution of iron or iron oxides contained in and on the material of the component, e.g., steel, and their constant re-deposition and restructuring take place. In contrast to a two-layer lacquering, where a second layer would be applied on top of the invariably static first layer, in a two-bath blackening process, the second bath also transforms the already deposited first oxidation depth again. The oxide layer becomes denser and more stable, the percentage of free FeO decreases in favour of $Fe_3O_4$. The deeper the layer areas are, the slower the transformation takes place until it comes to a standstill and has usually reached its final desired oxidation state.

The metallic additive elements, which are applied to the component by a pre-immersion solution, for example, are not only embedded in the blackening layer, but are also subject to a dissolution reaction. This means that they can be partially lost back into the black oxide bath during a restructuring of the area in which they are embedded.

If the component is immersed again in a suspension with metallic additive elements during the layer formation, especially between the blackening baths, the concentration of the metallic additive elements increases again from the layer surface and the metallic additive elements diffuse into the black oxide layer that is being further converted. This results in a concentration gradient, because the deeper a layer area lies, the more difficult it is to "refill" it with metallic additive elements. The end result is a black oxide with a measurable concentration gradient. The deepest areas of the layer have a lower content of metallic additive elements, towards the surface it becomes more and more. However, the metallic additive elements do not lie on the surface, but are located in the blackening layer, predominantly in the upper areas, with a concentration gradient towards the inside.

This differs from a conventional blackened surface, where additive elements only rest on the surface and are pressed into it during operation at most or are deposited in the outwardly open pores of the black oxide layer. In contrast, the metallic additive elements in the component proposed herein are demonstrably incorporated into the microstructure of the black oxide layer, with a maximum concentration near the surface of the black oxide layer, but not above it.

According to a further embodiment, the metallic additive elements are configured to adapt the properties of the black oxide layer. As already explained above, the properties of the additional elements are not used directly, but the metallic additive elements serve to adapt, in particular improve, the already existing properties of the black oxide layer.

Tests have shown that neither the colour nor the scanning electron microscopic surface structure or porosity of the layer alloyed with metallic additive elements show a relevant difference to a conventional black oxide layer. The corrosion protection as well as the friction was also identical in the context of the determination accuracy. In rolling contact, there was no significant difference in the wear track. In sliding tests, however, there were repeatable and significant differences between the component described herein and a component with a conventional black oxide layer.

It has been shown that the wear track for the component described herein was considerably reduced for all loads in the test set-up used as a basis:

at 0.9 GPa from 0.85 μm to 0.50 μm (−41%)

at 1.1 GPa from 1.50 μm to 0.85 μm (−43%)

at 1.4 GPa from 2.15 μm to 1.20 μm (−44%)

The investigation by means of nanoindentation tests has shown the following improvements of the alloyed black oxide layer described herein compared to conventional black oxide layers:

- Hardness increase of the alloyed blackening on smooth polished surfaces to 227%.
- Hardness increase of the alloyed blackening on ground rough surfaces to 192%.
- Increase of the modulus of elasticity on smooth polished surfaces to 220%.
- Increase of the modulus of elasticity on ground rough surfaces to 229%.

In summary, the black oxide layer described herein, which has been alloyed with metallic additive elements, can achieve twice the hardness, twice the modulus of elasticity and half the sliding wear compared to conventional black oxide layers. Here, however, as already explained, no separate layer is provided by the metallic additive elements, but the "soft" black oxide layer, which tends to wear quickly under sliding conditions, is doubled in its relatively low hardness and resistance. The other required properties are not damaged in the process.

The alloyed black oxide layer shows improved properties in particular in the presence of sliding motion shares. Since many components, such as guiding rods or piston rods, have more or less sliding motion shares, depending on their design and application, the improved wear resistance in sliding motion is relevant for these components.

According to a further embodiment, the metallic additive elements may comprise titanium. In particular, the metallic additive elements comprise a metal oxide, especially titanium oxide or titanium iron oxide.

A black oxide involves $Fe_3O_4$ (magnetite), whose crystal structure has a cubic symmetry. When choosing the metallic additive elements, particular attention should be paid to add or create a compound that is as similar as possible to the magnetite, especially one based on iron oxide. This compound should have approximately the same hardness and properties, but should not have a cubic but, for example, a trigonal lattice structure. If the additional elements have similar properties but a different lattice structure, the combination of the different lattice structures leads to a new and inevitably slightly distorted arrangement. The disturbances in the lattice structure and the available slip planes can significantly shift the hardness and modulus of elasticity of the overall layer. The actual structure of a blackening described only simplistically as $Fe_3O_4$ is a much larger structure of the approximate description $Fe_{11}O_{16}$ and can therefore be effectively strained by addition of very small percentages of other related lattice structures, especially at the Fe defect. Similar effects can be measured from the combination of $Fe_3O_4$ with an excess of $Fe_2O_3$.

Ilmenite ($FeTiO_3$), for example, can be used as an additive in the layer structure, which has all the desired properties. It is black, as is usual with black oxide. It has a similar Mohs hardness to magnetite. It is also an iron oxide. It has a trigonal structure and thus has the potential to strain and harden a cubically structured layer in the lattice. It has Ti as a well detectable element, which gives information about the ilmenite content of the layer. Since ilmenite uses only one Fe atom in its structure, it cannot hinder the parallel $Fe_3O_4$ formation in all conceivable concentrations. The excess oxygen from the nitrite of the black oxide bath can cover the formation needs of the ilmenite at any time.

Other mixed oxides are conceivable. In addition to ilmenite ($FeTiO_3$), $FeTiO_4$ (iron II titanate) and $FeTiO_5$ are also possible in the black oxide layer. Thus, in addition to the three iron oxides FeO, $Fe_2O_3$ and $Fe_3O_4$, a triple group of iron titanium oxides can be present in the case of excess oxygen, namely $FeTiO_3$, $FeTiO_4$ and $FeTiO_5$.

Preferably, mixed oxides can be combined with mixed oxides. This will produce a closely related iron titanium oxide if the oxygen ratio in the black oxide bath is not precisely maintained, rather than allowing the reaction to drift in undesirable other directions. Each of the iron titanium oxides is capable of structurally distorting the magnetite of the black oxide layer.

Various titanium compounds can be used for pre-immersion. These are all insoluble in water, which is why a suspension is created in the immersion bath for the metallic additive elements via air injection, as it is common for e.g., activation before phosphating (with partly other solids). Analogous to such an activation, at least one pre-immersion bath with an aqueous suspension is kept in the coating plant, in which the workpieces are immersed before the first blackening step and possibly repeatedly as a short interruption during the blackening time.

An extremely cost-effective and non-toxic titanium compound with high worldwide market availability is titanium dioxide, which is also inert and does not lead to any undesired side reactions. When used in a suspension, there is no hazard with regard to inhalation. Suitable particle sizes are specified for the preparation of the suspension, in particular KA 100 (0.25-0.35 mm).

Titanium dioxide is optionally available in the structures rutile, anatase and brookite, which are not equivalent in application. Industrially, the pigment is usually defined by the colour strength and the whiteness. Preferably, rutile can be used for the suspension, which at the same time has the highest colour strength and is the most widely used structure in commerce. Thus, a raw material with a colour strength of at least 1280 is preferably defined for the pre-immersion process. Further raw material properties to be specified for a successful application can be, for example, the oil number (preferably max. 25g/100 g), the sieve residue 45 (preferably<0.015%) and the purity content (preferably>98%).

Since titanium dioxide has an influence on the oxidation behaviour of iron, it can preferably be used as a metallic additive element. Titanium dioxide (TiO2) advantageously changes the ionic diffusion of the oxygen anion O with iron and iron oxide. Here, an external Fe cation diffusion is replaced by an internal O anion diffusion. This means that the addition of TiO2 does not only improve the diffusivity of the oxygen anion in the substrate and black oxide layer and support the layer formation, but that the dominant ion transfer mechanism for the oxidation of iron is exchanged in favour of a more efficient variant.

It has been determined that the incorporation of titanium compounds into the black oxide layer follows a natural mass ratio. The black oxide layer typically incorporates about 0.4-0.7% titanium. If the pre-immersion suspension is operated with a greatly increased titanium dioxide concentration, for example with double the concentration, the same result is nevertheless obtained. This is due to the fact that the incorporation of titanium mixed oxides into the structural Fe11O16 matrix follows a certain ratio, just as a chemical reaction can only process certain percentages of the reaction partners. This fact allows a particularly simple and stable bath management of the pre-immersion suspension since it can be run with a concentration surplus as a chemical stock and the same result is always achieved despite varying concentration.

While the nominal ideal concentration of titanium dioxide in the pre-immersion suspension was set at 10 g/litre, the equally functional tolerance range could be set at 5-20 g/litre without any variation in results.

The temperature of the pre-immersion suspension also does not lead to changes in the result. Room temperature as well as a heated elevated temperature produce the same adhesive seed accumulation with the same intensity and similar adhesion. In order to ensure the process stability of the pre-immersion, in addition to a stable suspension due to constant and sufficient air injection via nozzle pipes at the bottom of the container for the purpose of intensive circulation and keeping in suspension, attention should be paid to a bath preparation with deionised water or otherwise demineralised water as well as a sufficient dwell time of the workpieces in the suspension. For the first adhesive seed accumulation on a blank steel surface, a submerged dwell time of typically 2 to 5 minutes is required. In the case of an already existing black oxide layer, the surface energy and structure are altered, and the intermediate immersion processes can be shorter. The possibility of shorter intermediate immersion processes avoids a relevant drop in the core temperature of the workpieces, which would prolong the overall process.

According to a further aspect, a method of manufacturing a component as described above is proposed. The method comprises the following steps: depositing metallic additive elements on the component and immersing the component with the deposited metallic additive elements in a black oxide solution, wherein the metallic additive elements are incorporated in the structure of the black oxide layer and preferably over the approximately complete radial extent of the black oxide layer.

In particular, the metallic additive elements can be deposited by immersing in a pre-immersion solution. If titanium dioxide powder is used as the metallic additive element, it can be present as a suspension with a particle size of 0.25-0.35 mm in the pre-immersion solution. It has been found that about 10 g/litre is sufficient. Higher concentrations are possible, but not necessary.

By means of such a simple and cost-effective pre-immersion solution, an alloyed blackening can be reliably produced which, despite the very low content of alloying ingredients, i.e., ingredients of metallic additive elements, shows a doubling of its capabilities in several properties, as described above. This leads to the fact that with such an alloyed black oxide layer no premature losses of the black oxide layer occur in applications with increased sliding motion shares.

According to a further embodiment, the steps of depositing metallic additive elements and immersing in the black oxide solution are repeated, whereby the immersion in the black oxide solution is always the step following the deposition. Furthermore, the component can first be degreased and rinsed (in several steps) before the metallic additive elements are deposited.

An exemplary process with several pre-immersion or intermediate immersion and black oxide processes can proceed as follows:

- degreasing, cleaning, and rinsing of the material surfaces, if necessary with further activation aids.
- pre-immersing in a titanium dioxide suspension, which can be kept at room temperature as well as at elevated temperature,
- transferring to the first black oxide bath,
- optionally an interruption during the first blackening, e.g., after 10 minutes, for renewed quenching and intermediate immersing in the same titanium dioxide suspension, with immediate lifting back and further blackening,
- after completion of the first blackening, quenching in water as cool as possible,
- pre-immersing in a further titanium dioxide suspension, which can be kept at room temperature as well as at elevated temperature. This can be a second pre-immersion tank so as to not hinder the plant,
- transferring to a second black oxide bath,
- optionally, during the second blackening, an interruption, e.g., after 10 minutes, for renewed quenching and intermediate immersing in the same titanium dioxide suspension, with immediate lifting back and further blackening, after completion of the second blackening, quenching in water as cool as possible, finally, various cold and hot rinsing baths, then processing with dehydrating fluid and preservative oil.

If required, the process can be extended to include a third pre-immersion tank and a third black oxide bath as well as a third quenching rinse.

Compared to a black oxide system for tribological two-bath blackening, only two additional containers are required for alloyed blackening, which, apart from air injection, do not require any special mandatory equipment, in particular no heaters or cooling systems, no protective covers, and no particularly high-quality materials. The start-up of these additional containers can be optionally switched on or off in the sequence programme for the individual workpiece type, without any changeovers or modifications being necessary between the batches with alloyed and unalloyed blackening.

The above-mentioned pre-immersion tanks can have a titanium dioxide-water suspension, the TiO2 of which is kept in suspension under continuous air injection. When the component is immersed here, the surface of the component is seeded with titanium dioxide. The component is then moved directly into the first black oxide bath without rinsing. There, the immediate layer reaction takes place using the titanium dioxide present. As is known with seeding from phosphating, this seeding also does not detach from the surface when directly lifted over, while intermediate rinsing steps are avoided. Excess amounts of titanium dioxide, which can dissolve when immersed in the black oxide bath, go into the black oxide bath sludge and are not harmful. It has been found that titanium dioxide cannot be kept in suspension in the boiling black oxide bath, but precipitates immediately. This can then be disposed of together with the black oxide bath sludge.

Thus, the black oxide bath is not contaminated or degraded in any way and can be used for normal blackening at any time without the layer produced containing any Ti. This has the advantage that the same black oxide bath can be used for different blackening processes, with or without metallic additive elements from a previous pre-immersion step. Depending on the product and other requirements, the same plant can thus alternately produce unalloyed tribological black oxide layers or alloyed tribological black oxide layers without these processes interfering with each other.

In tribological black oxide, as described herein, the total blackening time is distributed over several blackening steps. For particularly long blackening times in a black oxide bath, the process is usually interrupted by intermediate quenching in a water bath to saturate elements with an affinity for oxygen and to reactivate the surface. Therefore, as described above, each black oxide bath and each blackening step can be preceded by a separate pre-immersion in a titanium dioxide suspension, or other pre-immersion solution containing metallic additive elements. This does not complicate or delay the coating process. This intermediate immersion leads to a renewed enrichment on the surface of the component to compensate for losses of titanium dioxide and to restore the natural Ti content of the layer of about 0.5%.

The features described in connection with the method apply equally to the component and vice versa.

Further advantages and advantageous embodiments are given in the description, the drawings, and the claims. In particular, the combinations of features given in the description and in the drawings are purely exemplary so that the features can also be present individually or combined differently.

BRIEF DESCRIPTION OF THE DRAWING

In the following, the invention will be described in more detail with reference to exemplary embodiments shown in the drawings. The exemplary embodiments and the combinations shown in the exemplary embodiments are purely exemplary and are not intended to define the scope of protection of the invention. This is defined solely by the appended claims.

It shows:

FIG. 1: a schematic sequence of a method for manufacturing a component.

DETAILED DESCRIPTION

In the following, identical or functionally similar elements are marked with the same reference signs.

FIG. 1 shows a possible schematic sequence of a method for manufacturing a component 1 with a black oxide layer 10. The component 1 is shown here as a ring or cylinder as an example, but any other shape can also be provided with such a black oxide layer 10.

The component 1 is first immersed in a pre-immersion solution 2 in which metallic additive elements are present. These metallic additive elements can be, for example, titanium dioxide, which is present in a titanium dioxide suspension in the pre-immersion solution 2. By immersing the component 1 in the pre-immersion solution 2, the metallic additive elements are deposited on the surface of the component 1, as exemplified here by beads 4.

The component 1 is then transferred to a black oxide bath 6. In this bath, the surface of the component is transformed into a black oxide layer 8. Thereby, iron and iron oxides contained in the material of the component 1 are dissolved and continuously re-deposited and restructured. The metallic additive elements 4, which are already deposited on the component 1, are thereby incorporated in the black oxide layer 8. In particular, the metallic additive elements are embedded in the structure of the black oxide layer 8.

The pre-immersion and blackening in the pre-immersion solution 2 and the black oxide bath 6 can be repeated as often as desired, preferably two to three times. Furthermore, the component 1 can be quenched after each black oxide bath 6.

After the black oxide process has been completed, a component 1 is available which has a homogeneous alloyed black oxide layer 10. The metallic additive elements 4 are embedded in this layer over the entire radial extent and are not recognisable as separate elements. Only a possible excess of additional elements could show up as a local concentration peak, but without being functionally disadvantageous. The metallic additive elements 4 serve in particular to adapt the properties of the black oxide layer 8 and do not contribute with their own properties.

This alloyed black oxide layer 10 can in particular be used to improve the properties of a black oxide layer in terms of wear resistance and degree of wear.

List of reference signs

1 Component

2 Pre-immersion solution

4 Metallic additive elements

6 Black oxide solution

8 Black oxide layer

10 Alloyed black oxide layer

The invention claimed is:

1. A component which has a black oxide layer, wherein metallic additive elements are alloyed in the structure of the black oxide layer wherein the metallic additive elements comprise titanium and/or titanium oxide and/or titanium iron oxide.

2. The component according to claim 1, wherein the metallic additive elements are provided with a percentage between 0.1 and 1 of the black oxide layer.

3. The component according to claim 1, wherein the metallic additive elements are alloyed in the black oxide layer with a percentage increasing radially outwards.

4. The component according to claim 1, wherein the metallic additive elements are configured to change the properties of the black oxide layer.

5. The component according to claim 1, wherein the black oxide layer is arranged on an area of the component being free of a rolling contact.

6. A method of manufacturing a component, the component having a black oxide layer, wherein metallic additive elements are incorporated in the structure of the black oxide layer, the method comprising the steps of:

depositing metallic additive elements on the component, and immersing the component with the deposited metallic additive elements into a black oxide solution, wherein the metallic additive elements are incorporated in the structure of the black oxide layer.

7. The method according to claim 6, wherein the deposition of the metallic additive elements takes place by immersion in a pre-immersion solution.

8. The method according to claim 6, wherein the steps of depositing metallic additive elements and immersion into the black oxide solution are repeated, wherein the depositing is followed by the immersion into the black oxide solution.

9. A component which has a black oxide layer, wherein metallic additive elements are incorporated in the structure of the black oxide layer wherein the metallic additive elements comprise titanium and/or titanium oxide and/or titanium iron oxide, wherein the metallic additive elements are provided with a percentage between 0.1 and 1 of the black oxide layer.

* * * * *